US012209477B1

(12) United States Patent
Schmidt et al.

(10) Patent No.: US 12,209,477 B1
(45) Date of Patent: Jan. 28, 2025

(54) WIRELINE CONVEYED CASING TEST PLUG AND PRESSURE TEST TOOL ASSEMBLY

(71) Applicant: Citadel Casing Solutions LLC, Houston, TX (US)

(72) Inventors: Daniel Lee Schmidt, Magnolia, TX (US); Todd Anthony Stair, Conroe, TX (US); Chris Champeaux, Houston, TX (US)

( * ) Notice: Subject to any disclaimer, the term of this patent is extended or adjusted under 35 U.S.C. 154(b) by 0 days.

(21) Appl. No.: 18/416,080

(22) Filed: Jan. 18, 2024

(51) Int. Cl.
*E21B 33/12* (2006.01)
*E21B 47/117* (2012.01)

(52) U.S. Cl.
CPC ..... *E21B 33/12* (2013.01); *E21B 47/117* (2020.05); *E21B 2200/08* (2020.05)

(58) Field of Classification Search
CPC ..... E21B 33/12; E21B 47/117; E21B 2200/08
See application file for complete search history.

(56) References Cited

U.S. PATENT DOCUMENTS 3,180,420 A * 4/1965 Manson, Jr. ..... E21B 33/1294 137/454.2
3,965,978 A * 6/1976 Conley ..... E21B 33/12 166/250.07
4,178,992 A * 12/1979 Regan ..... E21B 23/02 166/117.6
4,378,839 A * 4/1983 Fisher, Jr. ..... E21B 23/02 166/322
4,545,434 A * 10/1985 Higgins ..... E21B 23/02 166/217
4,648,446 A * 3/1987 Fore ..... E21B 23/06 166/134
4,718,488 A * 1/1988 Pringle ..... E21B 34/063 166/135
5,392,860 A * 2/1995 Ross ..... E21B 23/065 102/222
5,398,764 A * 3/1995 Collins ..... E21B 23/02 166/212
8,047,280 B2 11/2011 Tran et al.
9,243,472 B1 1/2016 Snider et al.
RE46,793 E 4/2018 Kellner et al.
9,976,384 B2 5/2018 Resweber
10,119,359 B2 11/2018 Frazier
10,655,426 B2 5/2020 Watson et al.
(Continued)

FOREIGN PATENT DOCUMENTS

AU 2012257565 A1 6/2016
CA 3087196 C 2/2021

*Primary Examiner* — Steven A MacDonald
(74) *Attorney, Agent, or Firm* — Avek IP, LLC

(57) ABSTRACT

A casing pressure test tool assembly includes a well extending from a top end to a downhole end, the well having a receptacle; a wireline tool to run into the well; a casing test plug positioned downhole of the wireline tool, the casing test plug having a plug body extending from a first end to a second end; and a wireline setting tool adapter connecting the wireline setting tool and the casing test plug; the casing test plug releases from the wireline setting tool upon application of a separation force between the wireline setting tool adapter and the plug body; the casing test plug seals within the receptacle of the well; and the casing test plug, once sealed within the receptacle, allows for casing pressure testing operations of the well.

18 Claims, 6 Drawing Sheets

(56) References Cited

U.S. PATENT DOCUMENTS

| | | | | |
|---|---|---|---|---|
| 11,459,874 | B1 | 10/2022 | Stair et al. | |
| 11,920,463 | B1 * | 3/2024 | Stair | E21B 33/12 |
| 2012/0181032 | A1 | 7/2012 | Naedler et al. | |
| 2022/0127948 | A1 * | 4/2022 | Helms | E21B 47/007 |
| 2023/0265735 | A1 | 8/2023 | Wright et al. | |

* cited by examiner

WIRELINE CONVEYED CASING TEST PLUG AND PRESSURE TEST TOOL ASSEMBLY

FIELD OF THE DISCLOSURE

The disclosure relates generally to plugs and tools for use in well operations. More specifically, the disclosure relates to a casing test plug configured to run downhole via a wireline, and a tool assembly including the casing test plug, a wireline tool, and a wireline adapter, the foregoing assembly configured to provide improvements during pressure testing operations of the well.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a casing test plug configured to be set by a wireline setting tool within a well. The casing test plug comprises a plug body extending from a first end to a second end; and a bore extending at least partially through the plug body. The plug body is configured to be retained to the wireline setting tool via a wireline setting tool adapter, the plug body is configured to release from the wireline setting tool upon application of a separation force between the wireline setting tool adapter and the plug body; the casing test plug is configured to seal within a receptacle within the well; and the casing test plug, once sealed within the receptacle, allows for casing pressure testing operations of the well.

In other aspects, the present invention relates to a casing pressure test tool assembly, comprising a well extending from a top end to a downhole end, the well having a receptacle positioned between the top end and the downhole end; a wireline tool configured to run into the well; and a casing test plug positioned downhole of the wireline tool. The casing test plug includes a plug body extending from a first end to a second end. A wireline setting tool adapter connects the wireline setting tool and the casing test plug. The casing test plug is configured to release from the wireline setting tool upon application of a separation force between the wireline setting tool adapter and the plug body; the casing test plug is configured to seal within the receptacle of the well; and the casing test plug, once sealed within the receptacle, allows for casing pressure testing operations of the well.

BRIEF DESCRIPTION OF THE SEVERAL VIEWS OF THE DRAWINGS

Illustrative embodiments of the present disclosure are described in detail below with reference to the attached drawing figures.

LIST OF REFERENCE NUMBERS

Figure 1:
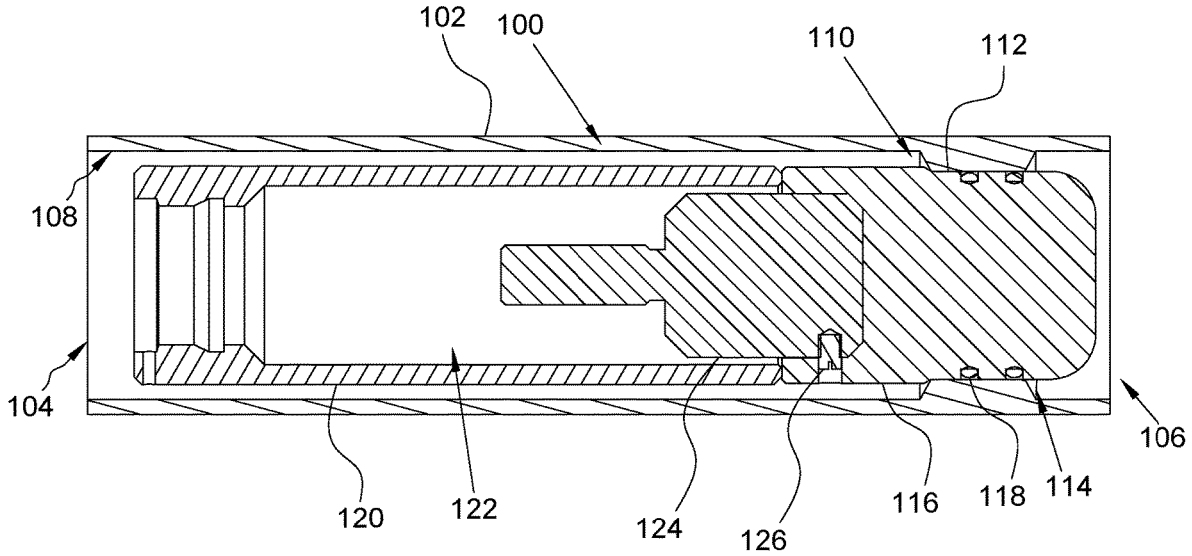
FIG. 1 is a side, cross-sectional view of a casing pressure test tool assembly with a wireline conveyed casing test plug positioned within a well, in accordance with the present invention.

100—casing pressure test tool assembly
102—well
104—top end
106—downhole end
108—inner surface of well
110—receptacle of well
112—shoulder
114—casing test plug
116—plug body
118—sealing member
120—wireline running tool
122—hollow core
124—wireline setting tool adapter
126—releasing member
200—first end of plug body
202—second end of plug body
204—outer surface of plug body
206—first section of plug body
208—second section of plug body
300—bore
302—first section of bore
304—second section of bore
306—main body
308—protruding body
400—main body
402—dissolvable core
500—main body
502—concave end
504—dissolvable ball
600—main body
602—protruding body The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. This complex industry utilizes a plurality of tools and assemblies in preparing a well for extraction of oil and/or gas from the formation surrounding the well. One common step in preparation is isolation and/or pressure testing. After initial drilling operations are performed, a section of the well may be conventionally isolated by running a bridge plug downhole, wherein the bridge plug is configured to isolate some portion of the well from another portion of the well. After the bridge plug is run and set, the bridge plug is used to prevent flow out of the well, or past the bridge plug, and accordingly the entire length of the wellbore above the bridge plug can be pressured up for casing pressure testing. In other conventional operations, a dissolvable ball may be dropped through a frac stack and wellhead, and then pumped down and seated near the bottom of the well, such that the ball blocks fluid flow and allows for pressure testing within the well.

Casing pressure testing is performed to test the integrity of the well to ensure safety and structural parameters are met. A pressure test is generally conducted to evaluate the integrity of the casing and cement, and to determine the maximum pressure that may be safely applied without a risk of formation breakdown. Previous tools and methods discussed above and conventionally used in performing isolation and pressure testing have drawbacks and limitations. Specifically, conventional bridge plugs are prone to becoming lodged in a well liner due to the external geometries of the bridge plug. Conventional bridge plugs have sealing elements that may become damaged while being conveyed to the end of the well, which can therefore prevent proper sealing of the bridge plug once set. After setting and pressure testing, in conventional operations, wireline guns are fired to create alternate flow paths, however wireline guns are prone to misfires, which would be a failure to create an alternate flow path for future frac operations, and therefore require expensive intervention operations. Further, dissolvable balls are exposed to grease while in a frac valve, wherein the grease can then prevent correct dissolution at a later time. Dissolvable balls are also prone to being pumped into flowback lines instead of downhole, which then prevents use of the dissolvable ball as a sealing mechanism. And yet further, dissolvable balls usually require a high pumping rate for the ball to reach the end of the well, and in some formations, achieving the necessary pumping rate is difficult or impossible. And lastly, the dissolvable ball may begin to dissolve prematurely, leaving a rough surface on the ball or insufficient diameter to create a secure seal. These are some limitations that the present invention aids in overcoming and improving thereupon.

The present invention includes a casing pressure test tool assembly having a casing test plug connected to a wireline tool via a wireline tool adapter, wherein the casing test plug is run downhole via the wireline tool and set in a downhole receptacle of the well. Once the casing test plug is sealed within the receptacle of the well, pressure is applied to the casing to achieve a casing pressure test. After the pressure test, the pressure is then bled off and the wireline adapter releases from the casing test plug. In alternatives, the casing test plug is set into the receptacle, the wireline adapter releases, and then pressure is applied to achieve a casing pressure test. After pressure is released, perforating guns are fired to provide a secondary method for future wellbore re-entry operations using an electric line.

FIG. 1 depicts an embodiment of a casing pressure test tool assembly 100 within a well 102. The well 102 extends from a top end 104 to a downhole end 106, the well 102 having an interior surface 108 with a receptacle 110 extending therein. The receptacle 110 creates a portion of the well 102 that is of a smaller diameter than the main run of the well. The receptacle 110 may be formed by any means understood by those skilled in the art, however, in some embodiments, a shoulder 112 extends inward from the inner surface 108 to create a lesser diameter section as shown.

The casing pressure test tool assembly 100 includes a casing test plug 114 which may vary, as will be discussed herein, the casing test plug 114 having a plug body 116 with at least one sealing member 118 such that the plug body 116 seals within the receptacle 110 as shown. The sealing member(s) 118 may vary, such as being an elastomeric body (e.g. O-ring) extending around a periphery of the plug body 116. Although two sealing members 118 are shown, those skilled in the art will appreciate that additional or fewer sealing members may be used. Yet further, those skilled in the art will appreciate that the plug 114 may seal directly within the receptacle 110 due to the smaller diameter of the receptacle 110 created with the shoulder 112.

The casing test plug 114 is coupled to a wireline tool 120 with hollow core 122 via a wireline adapter 124. Again, the wireline adapter 124 may vary as will be discussed herein. The wireline adapter 124 is coupled to the casing test plug 114 via one or more releasing members 126, such as sheer pins. The releasing member(s) 126 allows for the wireline adapter 124 and the wireline tool 120 to release the plug 114 once positioned and secured within the receptacle 110 upon a releasing force being applied thereto. The releasing member(s) 126 may be selected in number, style, or size, such that the force needed to release can vary as needed. In other words, the plug 114 is run and set within the receptacle 110 via the wireline tool 120 and wireline adapter 124 and either before or after pressure testing, the plug 114 is released from the adapter 124.

In the embodiment shown in FIG. 1, the plug 114 does not include a hollow core or a dissolvable element, however in alternative embodiments, as shown in FIGS. 3-6, the plug 114 includes a bore 300, allowing for fluid flow therethrough.

The present invention provides for three main uses, specifically (1) a method to pressure test the well by sealing the wellbore at the location of the receptacle 110; (2) a method of accurate depth correlation by means of pressure indication correlated to an electric line depth measurement; and (3) a method of fluid diversion for a first stage frac by shutting off the fluid exit point at the location of the receptacle 100 within the wellbore.

During operations, the well 102 is first established with the receptacle 110 built in. The plug 114 is then run downhole via the wireline tool 120 and wireline adapter 124 until the plug 114 is sealed into the receptacle 110. After sealing, the wireline tool 120 and wireline adapter 124 may either remain attached to the plug 114, or they may be released from the plug 114, and then pressure testing can be performed, wherein pressure is applied based on well parameters as would be understood by those skilled in the art. After pressure is released, and after the wireline tool 120 and adapter 124 are released from the plug 114, perforating guns are fired to provide a secondary method for future wellbore re-entry operations using an electric line.

Figure 2:
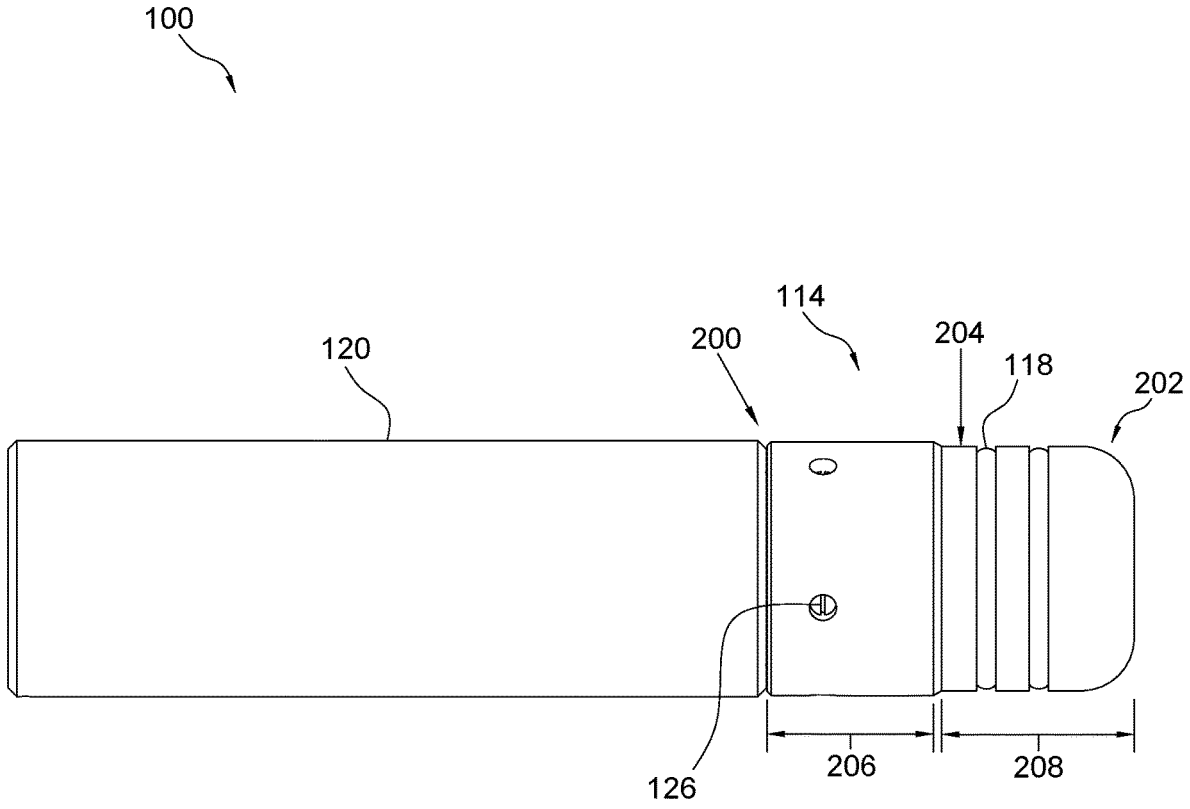
FIG. 2 is a side view of the casing pressure test tool assembly of FIG. 1.

In FIG. 2, a side view further depicts an embodiment of the assembly 100 having the wireline tool 120 coupled to the plug 114. The plug 114 includes the plug body 116 which extends from a first end 200 to a second end 202. The plug body 116 having a first section 206 and a second section 208, the first section having a greater diameter such that the plug 114 can only extend partially into the receptacle 110 as shown in FIG. 1. In embodiments, the sealing member(s) 118 are recessed into the body 116 at least partially below an outer surface 204, which is in protecting the sealing members 118 from debris and fluid.

Figure 3:
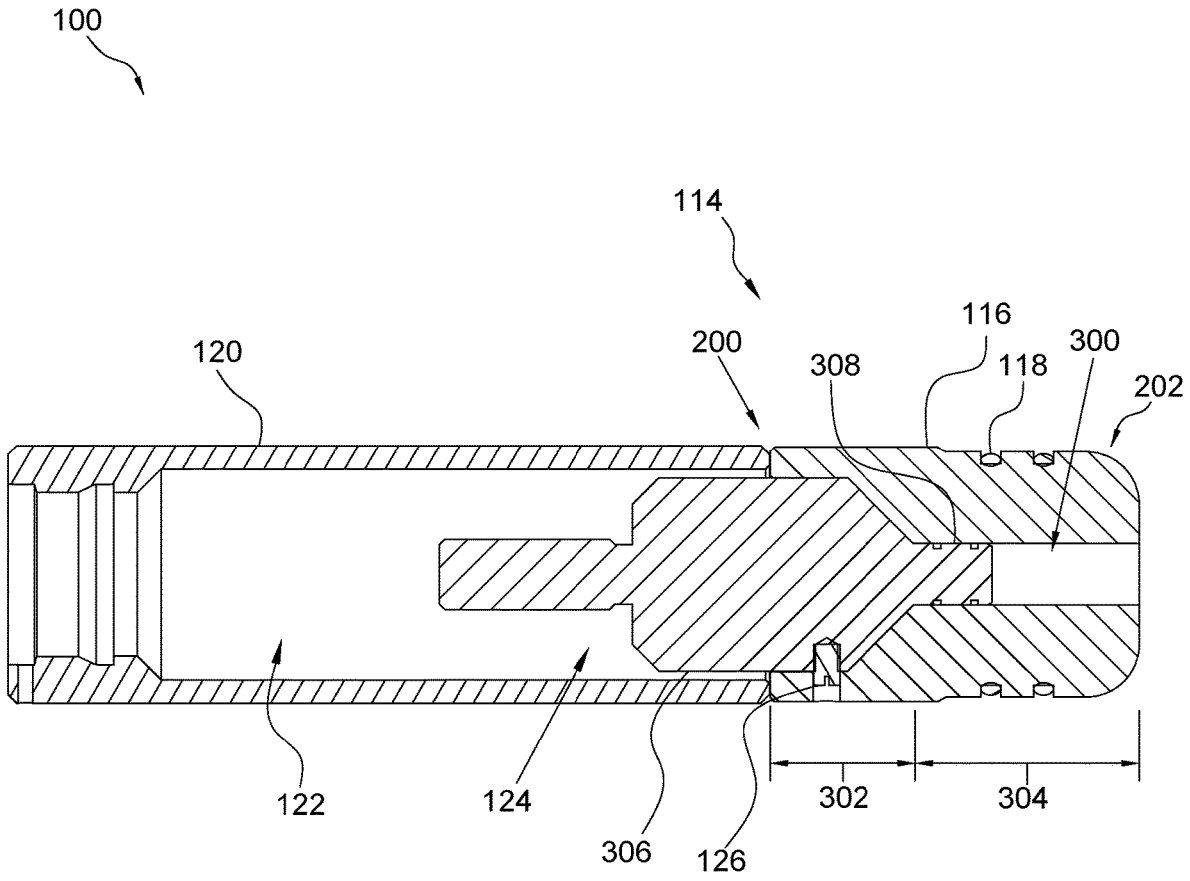
FIG. 3 is a side, cross-sectional view of a first embodiment of a casing pressure test tool assembly.

FIGS. 3-6 depict side cross sectional views of some contemplated embodiments of the assembly 100. As shown in FIG. 3, the plug 114 may further include a bore 300 that extends from the first end 200 to the second end 202, wherein the bore 300 may include a first section 302 and a second section 304. As shown, the adapter 124 can also vary, having a main body 306 coupled to the plug body 116 via releasing member(s) 126. A protruding body 308 can extend into the second section 304 of the bore 300 to ensure a tight seal until the adapter 124 is released therefrom.

Figure 4:
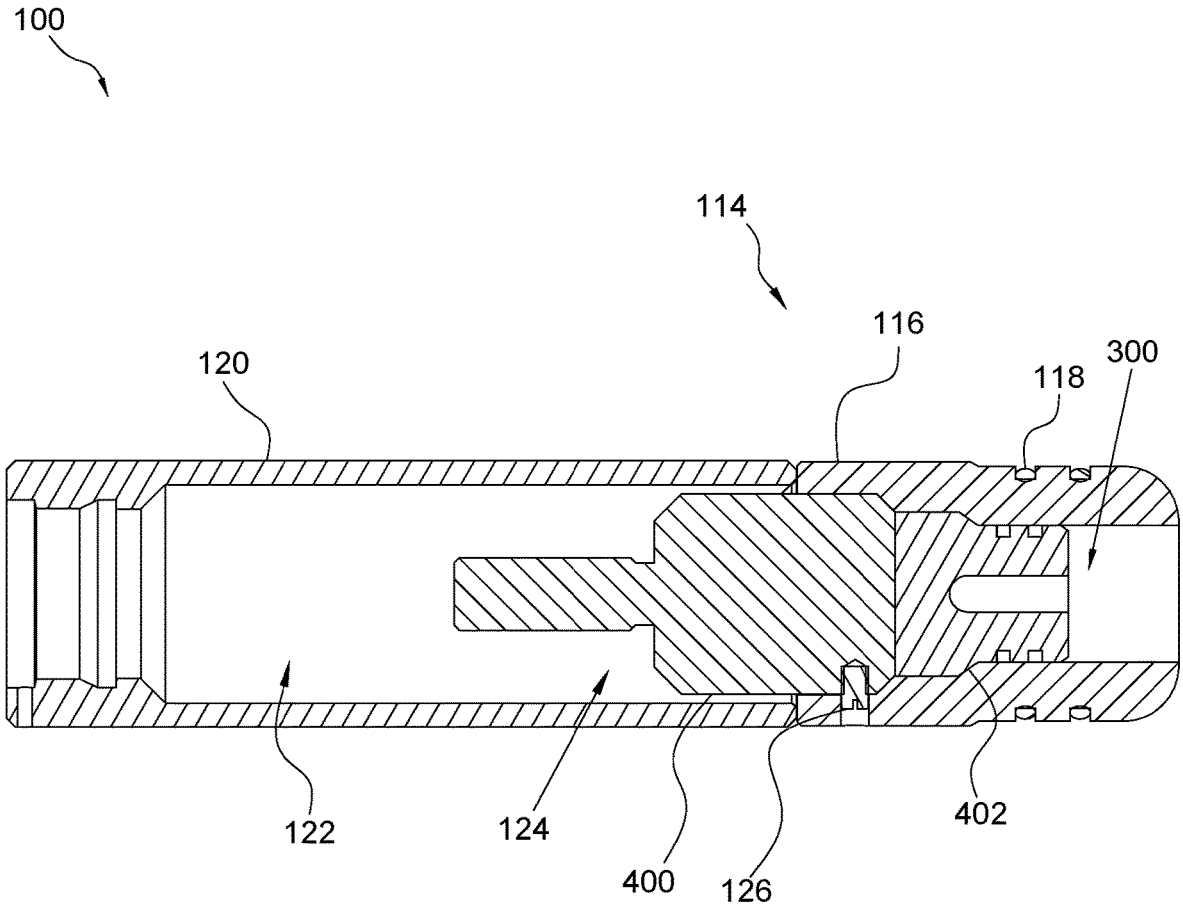
FIG. 4 is a side, cross-sectional view of a second embodiment of a casing pressure test tool assembly.
Figure 5:
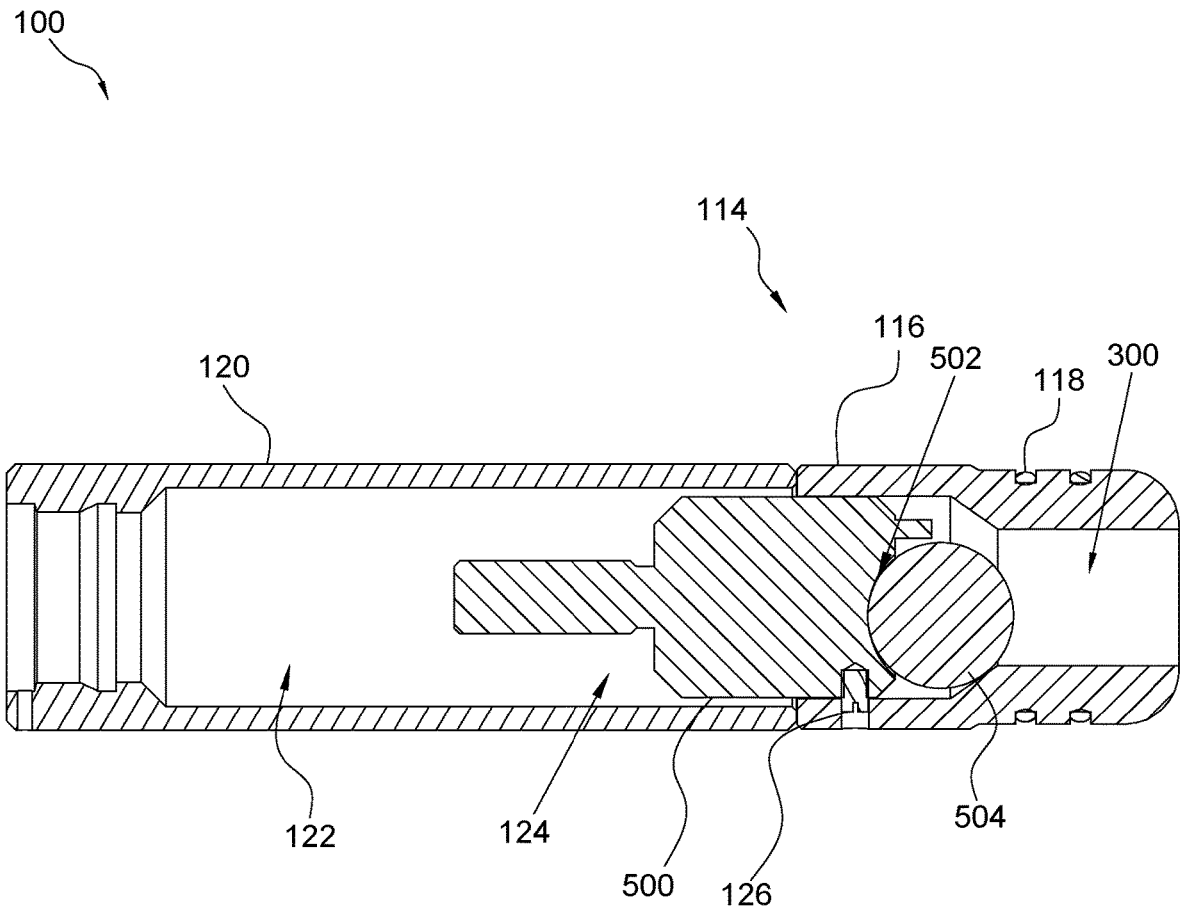
FIG. 5 is a side, cross-sectional view of a third embodiment of a casing pressure test tool assembly.

As shown in FIG. 4, the plug 114 may include a dissolvable core 402 positioned substantially adjacent to a main body 400 of the adapter 124. Again, the dissolvable core 402 is designed such that the bore 300 is sealed until dissolved. The dissolvable core 402 allows for a secondary pump down method should perforating guns fail to fire and accordingly would prevent the need for coil tubing interventions. Similarly, as shown in FIG. 5, a dissolvable ball 504 may be used within the bore 300 to create a seal therein, the dissolvable ball 504 being adjacent to a concave end 502 of a main body 500 of the adapter 124. Again, a dissolvable element allows for opening of the bore 300 in the event of a perforating fun failure.

Figure 6:
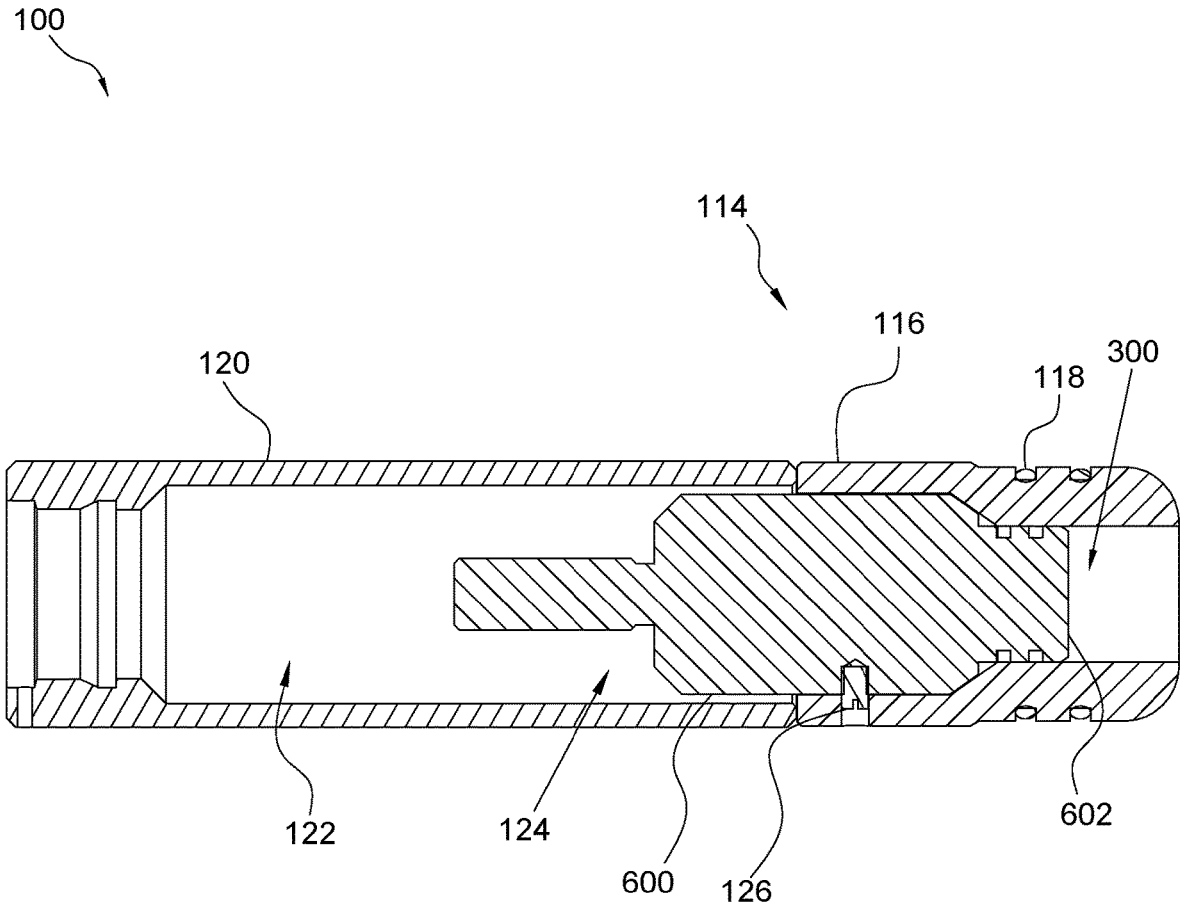
FIG. 6 is a side, cross-sectional view of a fourth embodiment of a casing pressure test tool assembly.

As shown in FIG. 6, the size of the bore 300 may vary, and accordingly, so too can the configuration of adapter 124, wherein a main body 600 and a protruding body 602 can be sized and shaped appropriately to couple the plug body 116 and seal the bore 300. Those skilled in the art will appreciate that modifications to the size, materials, and shapes of many of the components discussed herein may vary.

The present invention provides for advantages over conventional tools and methods. First, running the plug 114 via the wireline tool 120 and adapter 124 reduces the risk of a wireline bottomhole assembly getting stuck or pre-set. Second, the plug 114 and receptacle 110 sealing mechanism provides a more reliable method of holding pressure during a casing pressure test. Third, the assembly allows for depth correlation by using a pressure indication when seated, wherein the wireline depth counter would be compared to a casing tally to provide an accurate depth correlation.

When compared to a conventional dissolvable method, as discussed above, the present invention has a higher surface area and thus requires a lower pump rate to reach the receptacle 110. In addition, having the sealing member(s) 126 recessed into the plug body 116, protects the sealing member(s) 126 from becoming damaged, and therefore ensures a greater chance of a proper seal within the receptacle 110. And further, using a plug 114 with sealing member(s) 126, with potential dissolvable elements inside of the plug 114, ensures that the sealing mechanism itself does not prematurely begin to dissolve, again creating a higher probability of a proper seal within the receptacle. Accordingly, these are only some of the benefits of the present invention over the prior art.

The present invention may include additional features, such as the dissolvable ball or core, as discussed above, a secondary release mechanism should the wireline tool 120 fail to release from the plug 114, and a casing drift feature, which would extend around an outside perimeter of the plug 114 to near casing drift, eliminating the need for a separate gauge ring run.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A casing test plug configured to be set and released by a wireline setting tool within a receptacle of a well formed by a shoulder protruding inward into the well, the casing test plug configured for use during integrity testing of a casing, the casing test plug comprising:

a plug body having an exterior surface extending from a first end to a second end;

a bore extending at least partially into the plug body;

a wireline setting tool adapter, wherein the plug body is configured to be retained to the wireline setting tool via the wireline setting tool adapter, the wireline setting tool adapter configured to releasably attach to the plug body within the bore;

wherein the casing test plug body is configured to be released from the wireline setting tool and the wireline setting tool adapter upon application of a separation force between the wireline setting tool adapter and the plug body;

wherein the casing test plug is configured to be prevented from passing fully through the receptacle and to seal within the receptacle by the plug body coming into direct contact with the receptacle and to create the seal without utilizing any articulating sealing or locking components;

and wherein the casing test plug, once sealed within the receptacle, is configured for casing pressure testing operations of the well, wherein pressure is applied from the well surface to test casing integrity.

2. The casing test plug of claim 1, further comprising one or more elastomeric members positioned at least partially around the plug body at a position between the first end and the second end, the one or more elastomeric members recessed into the plug body and configured to aid in sealing the casing test plug within the receptacle.

3. The casing test plug of claim 1 wherein the bore further comprises a first section and a second section, the first section having a diameter greater than the second section.

4. The casing test plug of claim 3, wherein the plug body is configured to be secured to the wireline setting tool adapter within the first section of the bore.

5. The casing test plug of claim 3, further comprising a dissolvable ball configured to seal the second section of the bore until dissolved.

6. The casing test plug of claim 3, further comprising a dissolvable core positioned within the second section of the bore and sealing the second section of the bore until dissolved.

7. The casing test plug of claim 1, wherein the plug body further comprises a first section and a second section, the exterior surface being continuous along the first section and the second section, the first section having a diameter greater than the diameter of the receptacle such that the second section is configured to drop into the receptacle while the first section prevents the plug body from falling through the receptacle.

8. A casing pressure test tool assembly, comprising:

a well extending from a top end to a downhole end, the well having a receptacle formed by a shoulder protruding inward into the well, a diameter of the receptacle is smaller than a diameter of the well directly above the shoulder, the receptacle positioned between the top end and the downhole end;

a wireline setting tool configured to be run into the well;

a casing test plug positioned downhole of the wireline setting tool, the casing test plug having a plug body with an exterior surface extending from a first end to a second end, and a bore extending at least partially into the plug body; and a wireline setting tool adapter connecting the wireline setting tool and the casing test plug, the wireline setting tool adapter releasably attached to the casing test plug within the bore;

wherein the casing test plug is configured to release from the wireline setting tool adapter upon application of a separation force between the wireline setting tool adapter and the casing test plug;

wherein the casing test plug is configured to seal within the receptacle of the well;

wherein the exterior surface of the plug body and the receptacle are configured to come into direct contact to create the seal within the receptacle without utilizing any articulating sealing or locking components; and wherein the casing test plug, once sealed within the receptacle, is configured for casing pressure testing operations of the well, wherein pressure is applied from the well surface to test casing integrity.

9. The casing pressure test tool assembly of claim 8, wherein the casing test plug further comprises one or more elastomeric members positioned at least partially around the plug body at a position between the first end and the second end, the one or more elastomeric members recessed into the plug body and configured to aid in sealing the casing test plug within the receptacle of the well.

10. The casing pressure test tool assembly of claim 8, wherein the bore further comprises a first section and a second section, the first section having a diameter greater than the second section.

11. The casing pressure test tool assembly of claim 10, wherein the wireline setting tool adapter extends through the first section and partially into the second section, and is coupled to the plug body within the first section.

12. The casing pressure test tool assembly of claim 10, further comprising a dissolvable ball positioned within the second section of the bore and configured to seal the second section of the bore until dissolved.

13. The casing pressure test tool assembly of claim 12, wherein the wireline setting tool adapter further comprises a concave end positioned adjacent to the dissolvable ball until the wireline setting tool adapter is released from the casing test plug.

14. The casing pressure test tool assembly of claim 10, wherein the casing test plug further comprises a dissolvable core positioned within the second section of the bore and sealing the second section of the bore until dissolved.

15. The casing pressure test tool assembly of claim 8, wherein the wireline setting tool adapter is connected to the casing test plug via one or more sheer mechanisms within the bore, the wireline setting tool adapter is configured to release via shearing of the one or more sheer mechanisms upon application of the separation force.

16. The casing pressure test tool assembly of claim 8, wherein the wireline setting tool adapter further comprises a main body connected to the plug body via a releasing member.

17. The casing pressure test tool assembly of claim 8, wherein the plug body further comprises a first section and a second section, the exterior surface being continuous along the first section and the second section, the first section having a diameter greater than the diameter of the receptacle such that the second section is configured to drop into the receptacle while the first section prevents the plug body from falling through the receptacle.

18. A casing pressure test tool assembly, comprising:

a well extending from a top end to a downhole end, the well having a receptacle formed by a shoulder protruding inward into the well such that a diameter of the receptacle is smaller than a diameter of the well directly above the shoulder, the receptacle positioned between the top end and the downhole end;

a wireline setting tool configured to run into the well;

a casing test plug positioned downhole of the wireline setting tool, the casing test plug having a plug body with an exterior surface extending from a first end to a second end; and a wireline setting tool adapter connected to the wireline setting tool and releasably connected to the casing test plug via one or more shear mechanism, the one or more shear mechanism being the only connection means between the wireline setting tool adapter and the casing test plug;

wherein the casing test plug is configured to release from the wireline setting tool adapter upon application of a separation force between the wireline setting tool adapter and the casing test plug;

wherein the casing test plug is configured to seal within the receptacle of the well;

wherein the exterior surface of the plug body and the receptacle are configured to come into direct contact to create the seal within the receptacle without utilizing any articulating sealing or locking components; and wherein the casing test plug, once sealed within the receptacle, is configured for casing pressure testing operations of the well, wherein pressure is applied from the well surface to test casing integrity.

* * * * *